US005285702A

United States Patent [19]

Hillinger

[11] Patent Number: 5,285,702

[45] Date of Patent: Feb. 15, 1994

[54] EXTENDIBLE TOOL HANDLE

[76] Inventor: George Hillinger, 2140 Davie Ave., Commerce, Calif. 90040

[21] Appl. No.: 975,836

[22] Filed: Nov. 13, 1992

[51] Int. Cl.[5] ..... B25B 13/00

[52] U.S. Cl. ..... 81/177.2; 16/115; 403/109

[58] Field of Search ..... 81/177.1, 177.2; 16/115; 403/109

[56] References Cited

U.S. PATENT DOCUMENTS

| | | | |
|---|---|---|---|
| 2,641,012 | 6/1953 | Storrs | 16/115 X |
| 2,869,410 | 1/1959 | Prichard | 81/177.2 |
| 4,581,958 | 4/1986 | Shull | 81/177.2 |
| 5,109,737 | 5/1992 | Raber | 81/177.2 |

*Primary Examiner*—James G. Smith
*Attorney, Agent, or Firm*—Edgar W. Averill, Jr.

[57] ABSTRACT

An extendible handle for a tool to permit the user to increase the leverage applied by the tool. The extendible handle assembly has an inner handle member with a bushing affixed to its outer end. An outer handle member slides over the inner handle member and the outer handle member is hollow and contacts the bushing at the end of the internal handle. A bushing is also affixed to the inner end of the outer handle so that the handle cannot extend past the bushing on the inner handle. An air tight rearward air chamber is positioned between the outer end of the outer handle and an airtight forward chamber is formed between the internal bushing and the tool and bushing. An air passageway is provided along the internal bushing so that as the outer handle is moved in or out, this movement is damped by the necessity of air having to pass through the air passage in the internal bushing.

8 Claims, 2 Drawing Sheets

EXTENDIBLE TOOL HANDLE

BACKGROUND OF THE INVENTION

The field of the invention is hand tools and the invention relates more particularly to extendible handles which may be made longer or shorter as the tool to which the handle is affixed is being used.

Patents showing extendible handles include U.S. Pat. Nos. 2,282,148; 2,382,291; 2,438,633; 2,520,652; 2,869,410; 4,070,932; 4,307,634; 4,376,397; 4,440,517; 4,581,958; and 5,109,737. These patents mostly show extendible handles which have some means for setting the tool handle width at a number of discreet lengths. Most of the tool constructions are very expensive and not practical for a mass market. Many of the extendible tool handles require both hands to change the length of the tool handle.

SUMMARY OF THE INVENTION

It is an object of the present invention to provide an extendible tool handle which may be extended while the tool is affixed to a work piece by simply pulling out on the outer handle and which has a damping mechanism to control the rate at which the handle may be extended or contracted.

The present invention is for an extendible handle for a tool to permit the user to increase the leverage applied on a work piece. The extendible handle assembly has an inner handle member having an outer surface, a tool end and a remote end, said tool end including means for attachment to a tool. An internal bushing member is affixed to the inner handle member near the remote end thereof, and the internal bushing member has an inner end, an outer end, an outer surface, and an air passage extending from its inner end to its outer end. An outer handle member has a tool end and a remote end and has a smooth unapertured inner cylindrical opening within which the internal bushing member closely fits. The internal bushing member forms a forward air chamber within the cylindrical opening and a rearward air chamber behind the bushing. A tool-end bushing member is affixed near the tool end of the outer handle member and the tool-end bushing member has an inner passageway which closely fits the outer surface of the inner handle member. Preferably an O-ring groove and O-ring surround the internal bushing member so that it forms an airtight seal within the inner cylindrical opening of the outer handle member. Also, preferably an O-ring groove and O-ring is provided in the internal surface of the inner passageway of the tool end bushing member. Also, preferably the remote end of the inner cylindrical member is sealed with an airtight cap. Thus, air is captured in the rearward air chamber and forward air chamber and must pass through the air passage in the internal bushing member for the tool handle to be extended.

DESCRIPTION OF THE PREFERRED EMBODIMENTS

Figure 1:
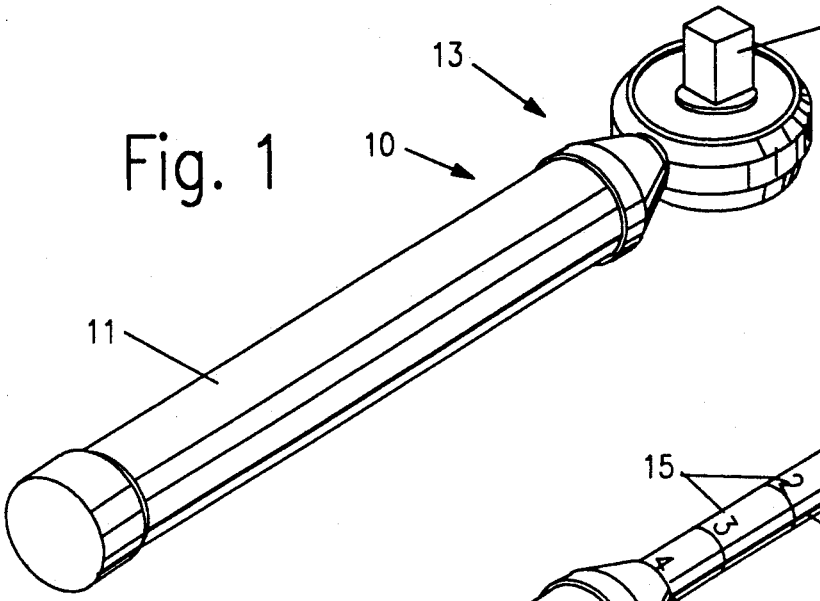
FIG. 1 is a perspective view of the extendible tool handle of the invention in a contracted position.

An extendible handle 10 for a tool is shown in a perspective view in FIG. 1 and indicated by reference character 10. Tool 10 has an outer handle member 11 and means for holding a tool such as the square drive.

Figure 2:
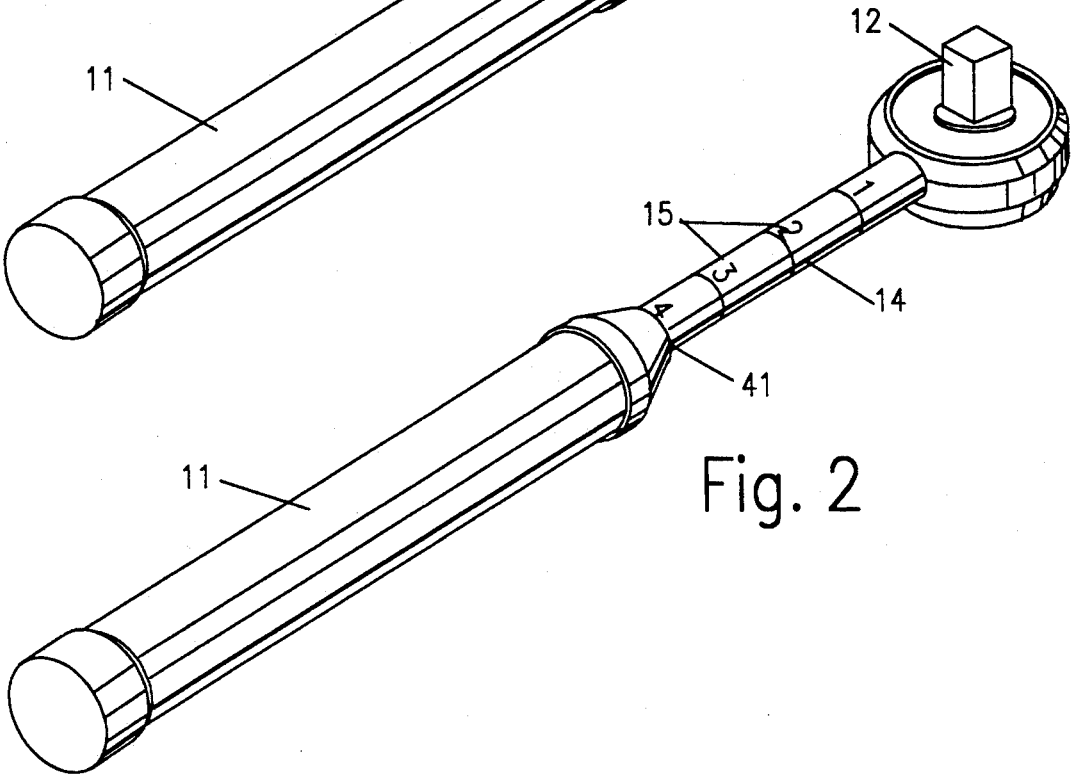
FIG. 2 is a perspective view of the tool handle of FIG. 1 with the handle in an extended configuration.

As shown in FIG. 2 outer handle member 11 may be extended from the tool holding means 13 exposing an inner handle member 14 having indicia 15 formed thereon.

Figure 3:
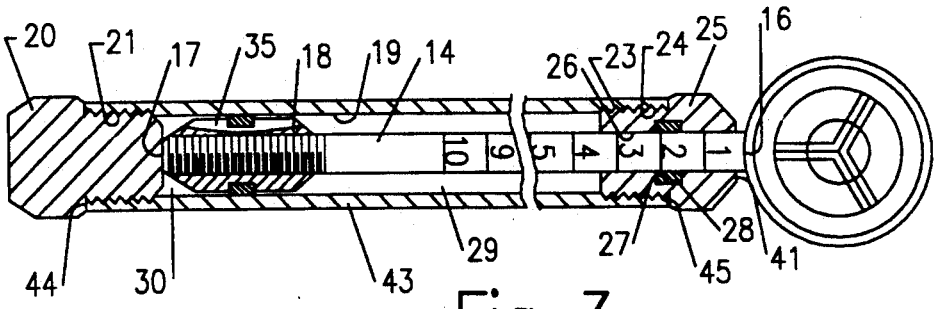
FIG. 3 is a cross-sectional view of the tool handle of FIG. 1.

The inner construction of the tool handle of FIGS. 1 and 2 is shown in FIG. 3 in cross section. There it can be seen that inner handle member 14 has a tool end 16 and a remote end 17. An internal bushing member 18 is threadably secured near the remote end 17 of inner handle member 14. Internal bushing member 18 is shown in detail in FIG. 4 and will be discussed below.

Outer handle member 11 has an inner cylindrical opening 19 which is smooth and has no apertures or other irregularities along the length contacted by the internal bushing member 18. An externally threaded end member 20 is threaded into threads 21 on inner handle member 14. This forms an essentially airtight seal between member 25 and bushing member 18. A tool-end bushing member 22 has external threads 23 into which the internal threads 24 are mated. This also forms an essentially airtight seal between threads 23 and 24 and tool-end bushing member 20 and the inner cylindrical opening 19. Tool-end bushing member 25 has an inner passageway 26 which has an O-ring groove 27 containing O-ring 28. This provides an airtight seal between the inner handle member 14 and inner passageway 26. It can be seen that the internal bushing member 18 divides the inner space and inner cylindrical opening 19 into a forward air chamber 29 and a rearward air chamber 30.

Figure 4:
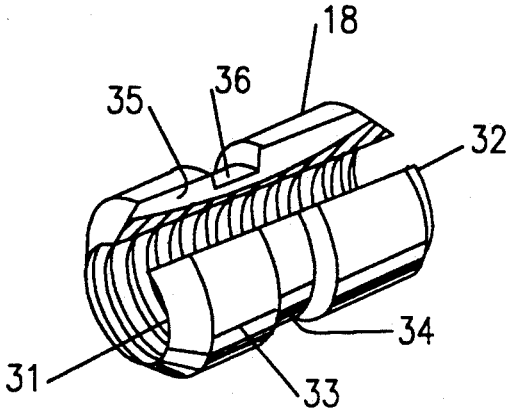
FIG. 4 is a perspective view, partly cut away, of the internal bushing member of the tool handle of FIG. 1.
Figure 5:
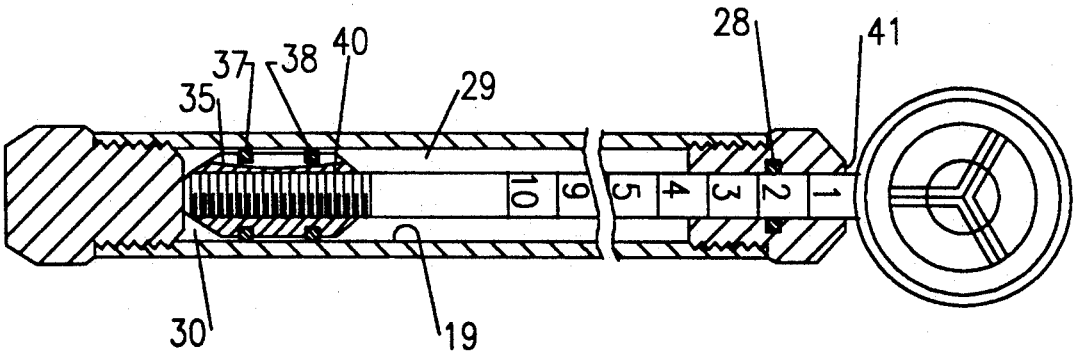
FIG. 5 is a cross-sectional view of an alternate embodiment of the tool handle of FIG. 1.

Turning now to the details of the internal bushing member 18 shown in FIG. 4, it can be seen that internal bushing member 18 has an outer end 31, an inner end 32, an outer surface 33 and an O-ring groove 34. An axially extending arcuate slot 35 is formed below the base 36 of O-ring groove 34 which permits air to pass under an O-ring which has been inserted in O-ring groove 34. Thus, as the handle is extended from the position shown in FIG. 1 to the position shown in FIG. 2, air must pass from forward air chamber 29 to rearward air chamber 30 through the air passage formed by axially extending arcuate slot 35. This damping affect caused by the necessity of passing air through this relatively small passageway permits the user to keep the tool at a desired position until it is advantageous to extend or contract the tool handle. This may be done by simply pulling out on the handle which forces air through slot 35 after which the tool could be used in a normal manner. It is important to note that it is not essential that the tool handle be fixed lengthwise with respect to the tool holding means 13. Thus, the expense and inconvenience of fixing the handle in discreet positions are largely not necessary. An alternate embodiment is shown in FIG. 5 where a pair of O-rings 37 and 38 are fitted in appropriate grooves about the outer surface of internal bushing member 40. This further provides additional support between the inner cylindrical opening 19 and internal bushing member 40.

As stated above, the tool end 41 of tool-end bushing member 25 provides an easy method of noting the position of outer handle member 11 by comparing it with indicia 15. It is also often important that the outer handle member 11 be contracted so that the tool may fit in a tight place.

It is also beneficial that the tool of the present invention can be made relatively inexpensively since the outer handle member may be fabricated from a tube portion 43 shown in FIG. 3 to which an end member 20 may be economically fitted. It, of course, does not require that threads be used and the end member may be simply adhered to or otherwise affixed in a relatively airtight manner to remote end 44 of tube portion 43. Similarly the tool-end bushing member 25 may be secured in a relatively airtight manner to tool end 45 of tube portion 43. The internal bushing member 18, although shown threaded on the end of inner handle member 14, may be pinned or otherwise economically affixed thereto. The result is a tool which may be manufactured at a reasonable cost and yet is highly functional.

While air passage 35 is preferably formed along the outer surface of internal bushing member 18, it could, of course, be formed by a groove in the inner surface of internal bushing member 18 or on the outer surface of the inner handle member 14 at the length over which the internal bushing member is positioned. The essential feature, however, is that air be permitted to pass from one side of the bushing member 18 to the other side in a restricted manner.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An extendible handle for a tool to permit the user to increase the leverage applied on the tool, said extendible handle comprising:

an inner handle member having an outer surface, a tool end, and a remote end, said tool end including means for attachment to a tool;

an internal bushing member affixed to said inner handle member near the remote end thereof, said internal bushing member having an inner end, an outer end, and an outer surface;

an air passage extending from said inner end to said outer end of said bushing member;

an outer handle member having a tool end and a remote end, said outer handle member having a smooth unapertured inner cylindrical opening within which the internal bushing member closely fits and the internal bushing forms a forward air chamber within said cylindrical opening between the internal bushing and a tool end bushing and a rearward air chamber behind said bushing;

a tool-end bushing member affixed near said tool end of said outer handle member, said tool-end bushing member having an inner passageway which closely fits the outer surface of the inner handle member, whereby said outer handle member may be extended away from the means for attachment of a tool to provide greater leverage or may be contracted to provide a shorter handle when there is not room for the extended handle and the movement of the outer handle member is dampened by the necessity of air to pass through the air passage of the internal bushing member between the forward air chamber and the rearward air chamber.

2. The extendible handle of claim 1 further including marking indicia on the outer surface of the inner handle member whereby the distance the handle has been extended may be observed by noting the indicia adjacent the tool-end bushing member.

3. The extendible handle of claim 1 wherein said internal bushing member includes at least one O-ring groove around the outer surface and has at least one O-ring in said O-ring groove and said air passageway extends under said O-ring.

4. The extendible handle of claim 3 wherein there are two of said O-rings.

5. The extendible handle of claim 1 wherein said outer handle member includes a tube and said inner cylindrical opening of said tube portion of said outer handle member has internal threads at a tool end and a remote end thereof and an end member having external threads is threaded at the remote end of said tube portion and said tool end bushing member is threaded into the tool end of said tube portion.

6. The extendible handle of claim 5 wherein said internal bushing member includes an O-ring groove and an O-ring supported in said O-ring groove.

7. An extendible tool handle assembly having a tool end and a remote end, said extendible handle having an outer handle member which extends outwardly away from said tool end of said tool handle assembly, said assembly comprising:

an inner handle member having a tool end and a remote end;

means for affixing a tool to the tool end of said inner handle member;

an internal bushing member having a tool end and a remote end, said internal bushing being affixed to said inner handle member near the remote end of said inner handle member, said internal bushing member having an outer surface;

an outer handle member slidingly held by said inner handle member, said outer handle member having a tool end and a remote end, and an inner cylindrical opening with an inside diameter which closely fits the outer surface of said internal bushing member, said outer handle member slidingly secured to said inner handle member, and said outer member having an air tight seal at the remote end thereof;

means to prevent air from passing between said outer surface of said internal bushing member and the inner cylindrical opening of said outer handle member thereby forming a forward air chamber between said internal bushing member and a tool-end bushing and a rearward air chamber between said internal bushing and said air tight seal on the remote end of said outer handle member said means to inhibit air from passing between said outer surface of said internal bushing member and the inner cylindrical opening of said outer handle member further includes an air passageway between the tool end of said internal bushing member and said remote end of said internal bushing member; and a tool-end bushing member affixed to the tool end of said outer handle member and having an inner passageway closely surrounding the outside surface of said inner handle member, whereby when said outer handle member is pulled away from the tool end of the inner handle member, the internal bushing member slides along the inner cylindrical opening of said inner handle member until it abuts said tool-end bushing member thereby increasing the leverage which can be applied to a tool affixed at the tool end of said inner handle member and the movement of the internal bushing is damped by the necessity of air to pass from the forward air chamber and the rearward air chamber.

8. The extendible tool handle assembly of claim 7 wherein said air passageway is an axially extending, arcuate slot formed through and below said at least one O-ring.

* * * * *